US007318492B2

(12) United States Patent
Watson et al.

(10) Patent No.: US 7,318,492 B2
(45) Date of Patent: Jan. 15, 2008

(54) ROTARY DRILL BIT

(75) Inventors: Graham Richard Watson, Gloucester (GB); John Martin Clegg, Tewkesbury (GB)

(73) Assignee: ReedHycalog UK Ltd (GB)

( * ) Notice: Subject to any disclaimer, the term of this patent is extended or adjusted under 35 U.S.C. 154(b) by 325 days.

(21) Appl. No.: 11/161,767

(22) Filed: Aug. 16, 2005

(65) Prior Publication Data

US 2006/0037785 A1 Feb. 23, 2006

(30) Foreign Application Priority Data

Aug. 18, 2004 (GB) ..... 0418382.8

(51) Int. Cl.
*E21B 7/08* (2006.01)
*E21B 10/14* (2006.01)

(52) U.S. Cl. ..... 175/73; 175/336; 175/378

(58) Field of Classification Search ..... None
See application file for complete search history.

(56) References Cited

U.S. PATENT DOCUMENTS

| | | | |
|---|---|---|---|
| 4,523,652 | A | 6/1985 | Schuh |
| 4,993,503 | A | 2/1991 | Fischer et al. |
| 5,213,168 | A | 5/1993 | Warren et al. |
| 5,341,888 | A | 8/1994 | Deschutter |
| 5,671,816 | A | 9/1997 | Tibbitts |
| 5,904,213 | A | 5/1999 | Caraway et al. |
| 5,967,246 | A | 10/1999 | Caraway et al. |
| 5,967,247 | A | 10/1999 | Pessier |
| 5,992,547 | A | 11/1999 | Caraway et al. |
| 6,092,610 | A | 7/2000 | Kosmala et al. |
| 6,092,613 | A | 7/2000 | Caraway et al. |
| 6,158,533 | A | 12/2000 | Gillis et al. |
| 6,188,222 | B1 | 2/2001 | Seydoux et al. |
| 6,216,802 | B1 | 4/2001 | Sawyer |
| 6,326,785 | B1 | 12/2001 | Kruspe |
| 6,516,898 | B1 | 2/2003 | Krueger |
| 6,581,699 | B1 | 6/2003 | Chen et al. |
| 6,834,733 | B1 | 12/2004 | Maouche et al. |
| 2002/0112894 | A1 | 8/2002 | Caraway |
| 2003/0183424 | A1 | 10/2003 | Tulloch |

FOREIGN PATENT DOCUMENTS

| | | |
|---|---|---|
| EP | 0 467 642 A2 | 1/1991 |
| WO | WO 97/27379 | 7/1997 |

OTHER PUBLICATIONS

EP 05 25 5067, filed Aug. 17, 2005: Annex to the European Search Report; Applicant ReedHycalog UK Limited.

*Primary Examiner*—Zakiya W. Bates
(74) *Attorney, Agent, or Firm*—Jeffery E. Daly

(57) ABSTRACT

A drill bit for drilling a borehole with a steerable drilling system, the drill bit comprising a longitudinal axis, and a cutting profile with a leading face section blended with a curved region into a tapered gauge region having a tapered gauge profile. The tapered gauge region being tapered with respect to the longitudinal axis determined by the steerable drilling system. The cutting profile and the gauge profile lie wholly within a bit profile envelope made up of a three dimensional surface of two complimentary conical sections set at the tilt angle and separated by and blended with a rounded section which forms an outermost diameter of the bit profile envelope. The rounded section has a diameter substantially equal to a maximum allowable API diameter for the drill bit, and further has a radius of curvature substantially equal to one-half the diameter.

15 Claims, 5 Drawing Sheets

ROTARY DRILL BIT

BACKGROUND OF THE INVENTION

1. Field of the Invention

This invention relates to a rotary drill bit, and in particular to an improved rotary drill bit suitable for use in a steerable drilling system.

2. Description of the Related Art

It is known, when drilling well bores for use in hydrocarbon extraction, to use steerable drilling systems to provide control over the direction in which the well bore is being drilled, and hence over the path along which the well bore extends. One type of steerable drilling system uses a downhole motor to control the angular position of a housing relative to the formation being drilled, the housing including an angled drive shaft carrying a drill bit such that the axis of rotation of the drill bit is angled to the axis of rotation of the housing. By appropriate control over the speed at which the housing is rotated relative to the speed at which the downhole assembly as a whole is rotated, the angular position occupied by the housing, and hence the drilling direction can be controlled. A steerable drilling system of this type falls into a category of drilling systems known as point-the-bit systems. A number of other steerable drilling systems are known.

Where a point-the-bit drilling system type is used with a conventional drill bit, upon using the tool to cause a change in drilling direction the drill bit is tilted relative to the hole. Such tilting causes the bit to foul against the adjacent formation. In order for the desired amount of tilting of the bit to occur, the parts of the formation against which the bit fouls must be drilled even though drilling of those parts of the formation may not otherwise have been necessary. Obviously this is undesirable as it is uneconomic and may result in increased bit wear. It may also negatively impact upon the steering accuracy, and also cause an oversize borehole to be drilled. The present invention provides drill bits suitable for use in such applications in which changes in drilling direction can be achieved with reduced effort.

BRIEF SUMMARY OF THE INVENTION

According to the invention there is provided a drill bit for drilling a borehole with a steerable drilling system, the drill bit comprising a longitudinal axis, and a cutting profile comprising a leading face section blended with a curved region into a tapered gauge region having a tapered gauge profile, the tapered gauge region being tapered with respect to the longitudinal axis at a tilt angle determined by the steerable drilling system. The cutting profile and the gauge profile lie wholly within a bit profile envelope comprising a three dimensional surface of two complimentary conical sections set at the tilt angle and separated by and blended with a rounded section which forms an outermost diameter of the bit profile envelope. The rounded section has a diameter substantially equal to a maximum allowable API diameter for the drill bit, and further has a radius of curvature substantially equal to one-half the diameter.

The drill bit may comprise a bit body adapted to be rotated about an axis of rotation, the bit having a leading face and a gauge region, the intersection between the leading face and the gauge region lying on a notional plane passing through the axis of rotation at a point about which, in use, the bit is tilted. Furthermore, the leading face of the bit may have a cutting profile of substantially part-spherical form having a center of curvature located at the said point, and the gauge region defines a gauge region of tapering shape.

The gauge region conveniently tapers at an angle at least as great as the maximum angle through which the bit is tilted, in use. The tapered gauge region has an angle of taper with respect to the longitudinal axis of 8° or less, and more typically has an angle of taper with respect to the longitudinal axis of 4° or less.

Such a bit is advantageous in that, upon tilting of the bit, fouling of the bit against the formation does not occur with the result that such tilting can be achieved with relatively little effort.

The gauge profile is conveniently of frusto-conical shape.

The invention also relates to a steerable drilling system comprising a point-the-bit type steering arrangement carrying a rotary drill bit of the type defined hereinbefore.

The steering arrangement conveniently includes a housing from which an angled drive shaft protrudes, the bit being mounted, in use, upon the drive shaft, and a downhole motor arranged to drive the housing for rotation about its axis.

BRIEF DESCRIPTION OF THE DRAWINGS

The invention will further be described, by way of example, with reference to the accompanying drawings.

DETAILED DESCRIPTION OF THE INVENTION AND THE PREFERRED EMBODIMENT

Figure 1:
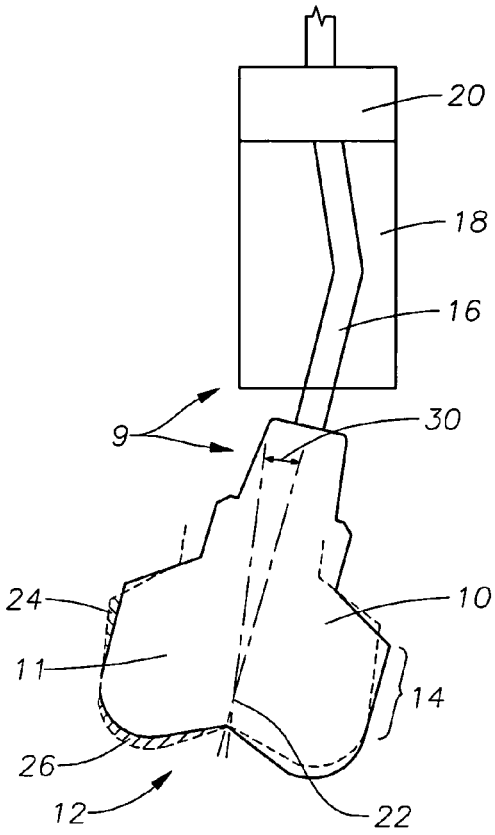
FIG. 1 is a diagrammatic view of a typical downhole steerable drilling system.
Figure 1A:
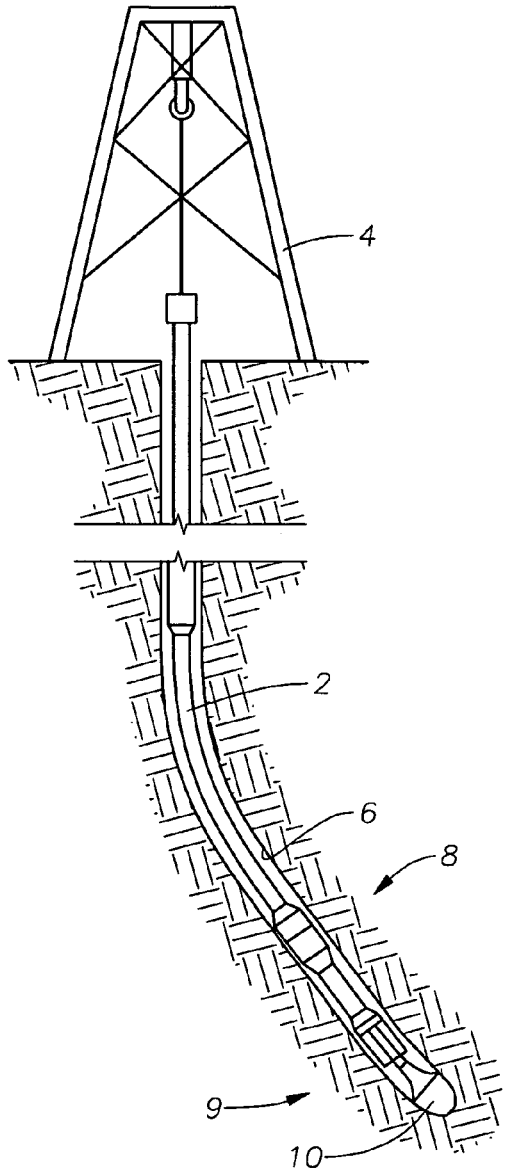
FIG. 1A is a diagrammatic view of a typical drilling rig for forming directionally drilled boreholes into the earth.

FIG. 1A shows a drill string 2 suspended by a derrick 4 for directionally drilling a borehole 6 into the earth for minerals exploration and recovery, and in particular petroleum. A bottom-hole assembly (BHA) 8 is located at the bottom of the borehole 6. In directional drilling, the BHA 8 typically has a downhole steerable drilling system 9 (illustrated diagrammatically in more detail in FIG. 1) and comprises a drill bit 10 having a leading face 12 and a gauge region 14. As the drill bit 10 rotates downhole it cuts into the earth allowing the drill string 2 to advance, forming the borehole 6. In the "point the bit" type of steerable drilling system 9 illustrated, the drill bit 10 may be carried by a drive shaft 16 which passes through a housing 18. Within the housing 18, the drive shaft 16 contains a bend such that the output part of the drive shaft 16 is not coaxial with the housing 18, but rather is angled thereto.

The housing 18 is carried by a downhole motor 20 arranged to rotate the housing 18 about its axis. The motor 20 is supported by the drill string such that, in use, rotation of the drill string causes the motor 20, housing 18 and drill bit 10 to rotate, operation of the motor 20 causing the housing 18 to rotate in the opposite direction with the result that, if the motor 20 is driven appropriately, the housing 18 can be held against rotation while the drill string continues to rotate.

In use, during normal operation of the downhole steerable drilling system, the motor 20 is operated to hold the housing 18 against rotation for a short period of time during which the drill bit 10 is rotated by the drive shaft 16 about its axis to cause formation material to be abraded, gouged or otherwise removed. Periodically, the motor 20 is controlled to cause an adjustment in the angular position occupied by the housing 18 which in turn causes an adjustment in the angle at which the drill bit 10 is held by the drive shaft 16.

It should be noted that similar problems are encountered in "push the bit" and other type of steerable drilling system 9. Although these systems may vary somewhat from details as described above, they all tend to cause similar problems with the drill bit 10, as the bit is typically tilted at an angle 30 in the hole to effect a change in drilling direction.

As illustrated in FIG. 1, adjustment of the angle 30 at which the bit 10 is held causes the drill bit 10 to be tilted from its longitudinal axis 32 about the point 22, for example to the position illustrated in broken lines. In order to achieve this tilting movement of the drill bit the portions of the surrounding formation located within the shaded areas 24, 26 must be removed to allow the drill bit 10 to occupy the new position. Clearly the need to remove these parts of the formation results in the system being wasteful, increasing the effort which is required in moving the drill bit 10 to this position, and this is undesirable.

Figure 3:
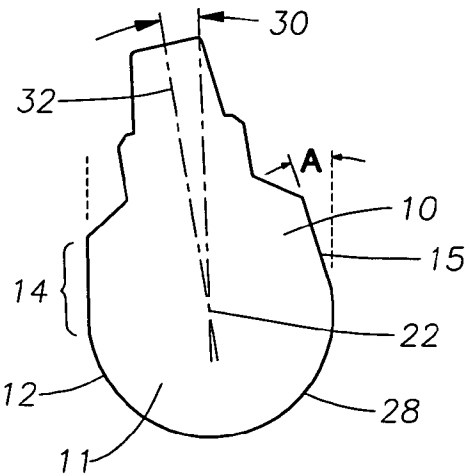
FIGS. 2 and 3 are diagrammatic views similar to FIG. 1 illustrating an embodiment of the invention.
Figure 2:
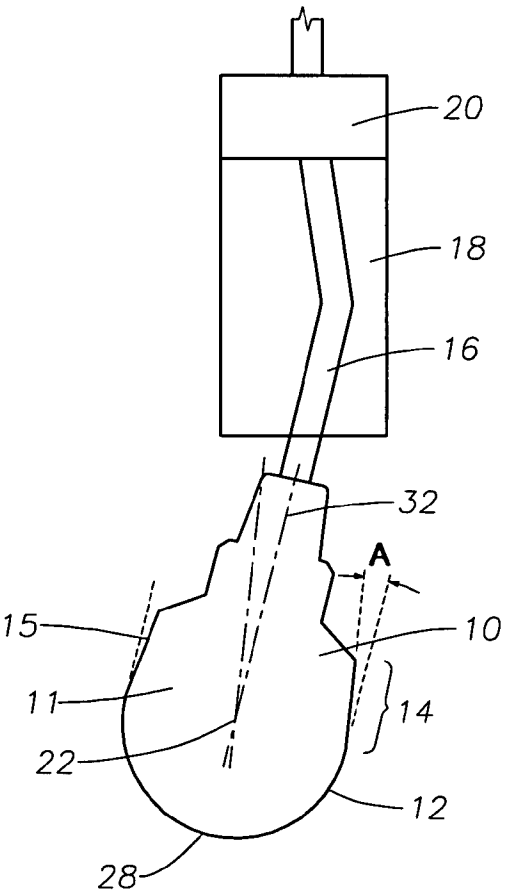

In one embodiment of the invention, as illustrated in FIGS. 2 and 3, the drill bit 10 is modified such that the leading face 12 thereof has a cutting profile 28 of substantially part-spherical form. Additionally, the gauge region 14 is shaped to be of tapering form.

The cutting profile 28 which may be of part-spherical form has a center of curvature located at the point 22. As a result, upon the drill bit 10 being tilted about the point 22, no additional formation material needs to be removed to allow the leading face 12 of the drill bit 10 to be moved. Further, as the gauge region is of tapering form, tilting movement of the drill bit 10 through an angle no greater than a designed maximum tilt angle for the drill bit 10 does not bring the gauge region 14 of the drill bit 10 into fouling engagement with the surrounding formations. It will be appreciated, therefore, that a drill bit of the type illustrated in FIGS. 2 and 3 accommodates changes in drilling direction while requiring only a relatively small amount of effort.

In practice, it is unusual for the change in angular movement of the bit 10 to be greater than around 4°, however in some circumstances it may be as high as 8°. As such, the angle of taper of the gauge region 14 (denoted as 'A' in FIG. 2) is conveniently made to match, or be slightly more than, the angular movement (tilt angle 30), so as to ensure that fouling of the bit 10 against the formation does not occur. However, the angle of taper 'A' of the gauge region 14 may be varied depending upon the application and the amount of tilting of the drill bit which is likely to occur, in use.

In the illustrated embodiment, the leading face of the bit is of hemispherical form and the gauge region 14 has a gauge profile 15 of frusto-conical form. The intersection between the hemispherical leading face 12 and the frusto-conical gauge region 14 lies on a plane which intersects the bit axis at the point 22. It will be appreciated that in such an arrangement, a definite line exists at the intersection between the leading face and the gauge region. Arrangements are possible in which the part-spherical face forming the leading face 12 merges smoothly into the frusto-conical surface forming the majority of the gauge region 14. In such an arrangement, the gauge region 14 is not of truly frusto-conical form as it includes a small a curved region 134 (in FIG. 5) which is preferably part-spherical in shape where it meets the leading face 112, as shown in the preferred embodiment of the present invention in FIG. 5.

Figure 4:
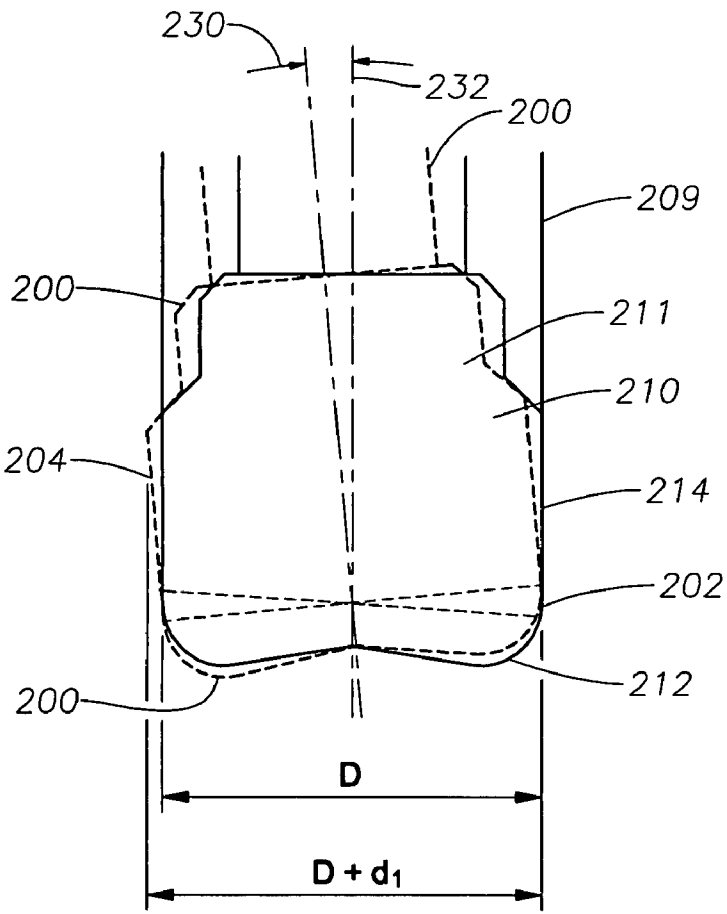
Fig. 4 (Prior Art)
FIG. 4 is a drill bit of the prior art, to help illustrate the benefit of the frusto-conical form of the present invention.

In order to illustrate the benefit of the frusto-conical form as it includes a small part-spherical region, a drill bit 210 of the prior art is shown in FIG. 4. As illustrated, the bit 210 has a bit body 211 and a perpendicular gauge region 214, leading to a face portion 212 and a longitudinal axis 232. The letter "D" represents the diameter of this drill bit 210 as it drills in a borehole 209. The dashed profile 200 of drill bit 210 represents its position within the borehole 209 when it is tilted an angle 230 as discussed above. The dashed profile 200 of the drill bit 210 has been shifted slightly to the left so that the rightmost portion of the profile 202 is within and just touches the borehole 209. This has been done in order to clearly demonstrate that this bit, when tilted, now drills a borehole that is larger by "d1" than the intended gauge diameter "D". As can be seen, this is caused in part by the straight (i.e. non frusto-conical gauge section) near the prior art bit's shoulder 204, and the displacement effect from shifting the rightmost portion of the profile 202 drill bit 210 toward the left. It is clear, therefore, that even if the frusto-conical form, as described above, were formed onto this drill bit 210, it would still drill a slightly oversized borehole. Although this effect may be quite minimal for small, conventional tilt angles, up to say around 4° on relatively small diameter drill bits, it may become pronounced when the directional drilling application requires a tilt angle beyond this amount, and/or a drill bit diameter that is greater than about 8¾". It is in these instances that the small curved, preferably part-spherical, region 134 as shown in FIG. 5 becomes important.

Figure 5:
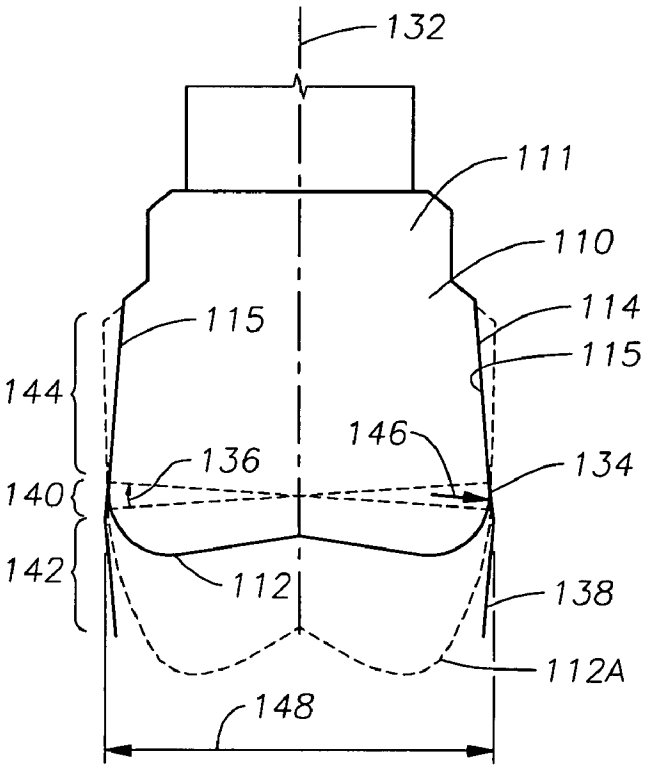
FIG. 5 is a diagrammatic view similar to FIG. 1 showing a drill bit of the preferred embodiment.

The drill bit 110 of the preferred embodiment is illustrated in FIG. 5. Drill bit 110 includes a bit body 111 and the tapered gauge region 114 having a gauge profile 115 with an angle of taper 'A' as described above, blended into the curved, preferably part-spherical, region 134, which is then blended with the profile portion 112 of the bit 110. There are a nearly infinite number of profile portion 112 designs possible as illustrated by an alternate profile portion 112A as shown. The small curved, preferably part-spherical, region 134 of the drill bit has an included angle 136 which is approximately double the tilt angle 30 (as shown in FIG. 3).

A drill bit profile envelope 138 may be defined for a bit once the diameter of the drill bit and amount of the tilt angle 30 have been established. The outermost dimensions of the drill bit must fit within this bit profile envelope 138 to assure that it will not drill an oversize hole at the given tilt angle 30. The drill bit may be made smaller than this envelope, in accordance with the American Petroleum Institute's (API) specifications for the diameters of fixed cutter drill bits as defined in their Specification 7, Fortieth Edition, November 2001, Effective date March 2002, section 9.2.1 "Diamond Bit Tolerances", incorporated by reference herein.

The bit profile envelope 138 is a three dimensional surface comprising three sections, two complimentary tapered conical sections 142 and 144, inwardly tapered at their outermost ends at the tilt angle 30 and blended with a rounded section 140 which is a partial section of a sphere of diameter 148. The diameter 148 is the outermost diameter 148 of the bit profile envelope 138. The value for the diameter 148 is the maximum diameter for a given size of drill bit allowed by the above referenced API specification, and may be constructed by using the maximum allowable API bit diameter as the diameter 148 of the rounded section 140. As stated above, since the rounded section 140 is a partial section of a sphere of diameter 148, it has a radius of curvature 146 equal to one-half of the maximum allowable API bit diameter. The rounded section 140 is then blended with larger ends of the two inward tapered conical sections 142 and 144 and rotated about the longitudinal axis 132. The taper section 142 in the bit profile envelope 138 is a mirror of taper section 144. The height of the rounded section 140 is derived from the radius of curvature 146 of this section 140 and the included angle 136 of the drill bit, as described above.

As will be appreciated by those skilled in the art, a drill bit made to fit within the bit profile envelope 138 as described above will drill a borehole to the proper diameter even if it is operated through a range of tilt angles—all the way from 0° to the tilt angle 30 that is the maximum for the steerable drilling system 9.

There are nearly an unlimited number of different drill bit cutting profiles 28,128 available, each one suited suitable for a specific drilling condition. However, most of these profiles may be adapted to fit within the bit profile envelope 138, as illustrated in FIGS. 6A-6G.

Figure 6A:
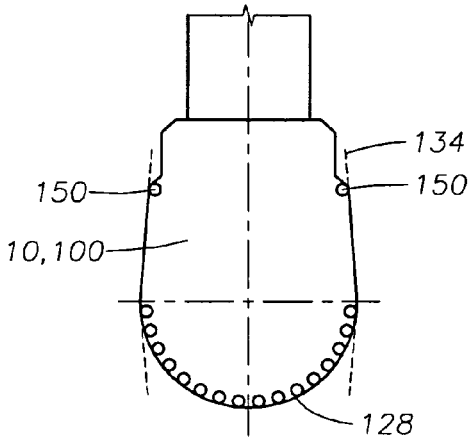
FIGS. 6A-6G are examples of seven of the many different bit profiles that may fit within the drill bit profile envelope.
Figure 6B:
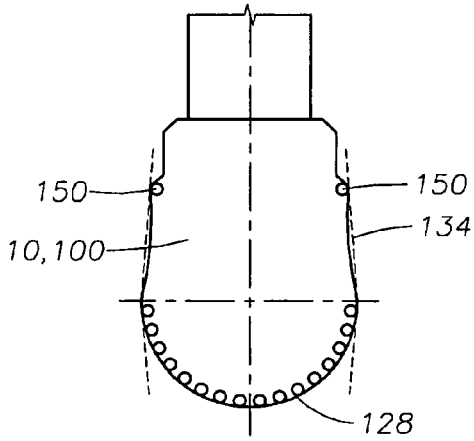
Figure 6C:
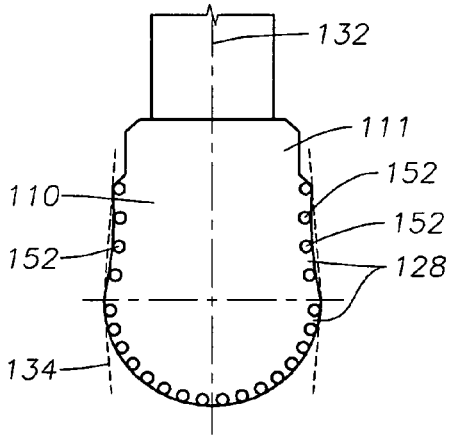
Figure 6D:
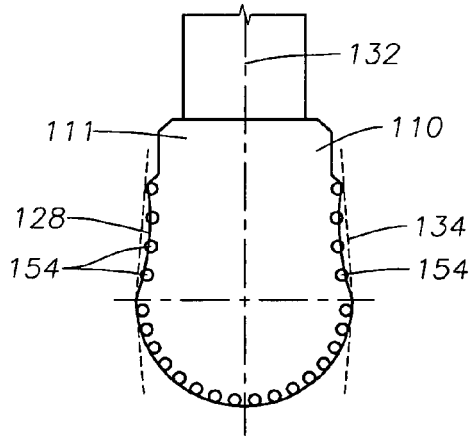

In FIG. 6A, the cutting profile 128 follows that taper, and terminating in 'active gauge' cutting elements 150. FIG. 6B shows a gauge section with a concave shape and may or may not have the same type of 'active gauge' cutting elements 150. FIG. 6C shows a concave gauge section designs to cut or ream the formation with very low protrusion gauge reaming cutters 152. FIG. 6D shows a concave gauge section similar to FIG. 6C, except it cuts or reams the formation with protruding gauge cutters 154.

Figure 6E:
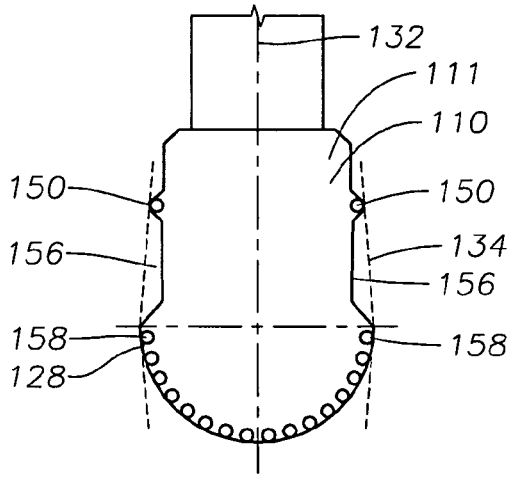
Figure 6F:
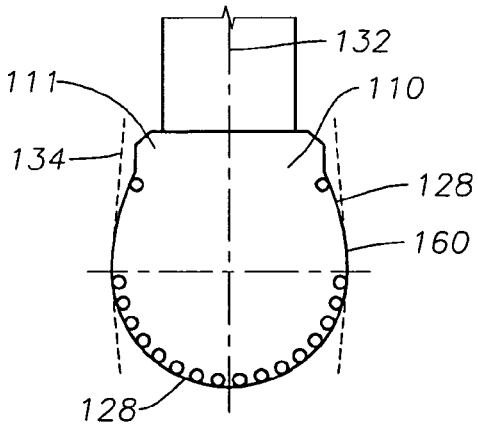
Figure 6G:
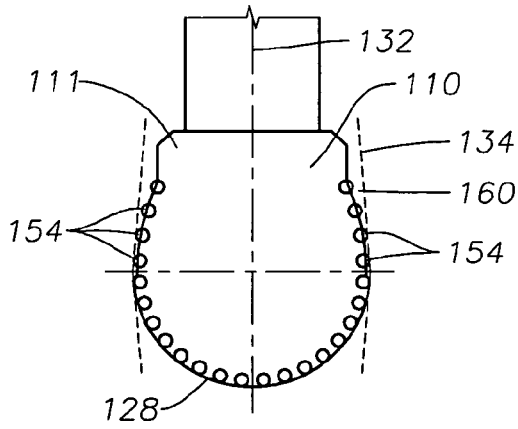

In FIG. 6E the section 156 between the 'active gauge' cutting elements 150 and the gauge cutters 158 is relieved from the bit profile envelope 138. Finally in FIGS. 6F and 6G are two drill bit cutting profiles 128 showing curves 160 (either circular or ellipse) with and without gauge reaming cutters 154, as described above The drill bit 10, 110 may take a range of forms. For example, the drill bit 10, 110 may comprise a matrix-type bit body 11,111 into which cutting elements, for example polycrystalline or single crystal diamond grains are embedded or impregnated, the diamond material serving to abrade the formation material upon rotation of the drill bit 10, 110. Alternatively, rather than a matrix type bit body 11, 111 with impregnated diamond grains, the bit body 11, 111 may be machined from metal, preferably steel, and a series of cutting elements may be mounted upon the bit body 11, 111. Such cutting elements may take the form of polycrystalline diamond compact cutters in which a table of polycrystalline diamond is bonded to a substrate of less hard material, for example tungsten carbide, which, in turn, is mounted upon the bit body 11,111. The bit body 11, 111 may be shaped to include a series of upstanding blades upon which the cutters are mounted, channels being formed between the blades. In such an arrangement, the bit body 11, 111 may be arranged to include nozzles to allow drilling fluid to be supplied to the channels between the blades for the purposes of cooling and cleaning of the cutters and to carry away from the drill bit material abraded, gouged or otherwise removed from the formation during drilling. In each case, in accordance with this embodiment of the invention, the cutting profile 28, 128 of the leading face 12, 112 of the bit 10, 110 is of substantially part-spherical shape.

It will be appreciated that the specific arrangement described hereinbefore may be modified in a number of ways within the scope of the invention. For example, the system used to point the bit 10, 110 in the desired direction may be modified somewhat. Further, a number of changes may be made to the specific shape of the drill bit 10, 110 while still ensuring that fouling of the drill bit 10, 110 with the formation does not occur during tilting movement of the drill bit 10, 110. Other modifications or alterations are also possible within the scope of the invention.

Whereas the present invention has been described in particular relation to the drawings attached hereto, it should be understood that other and further modifications apart from those shown or suggested herein, may be made within the scope and spirit of the present invention.

What is claimed is:

1. A drill bit adapted for drilling a borehole with a steerable drilling system, the drill bit comprising a longitudinal axis, and a cutting profile comprising a leading face section blended with a curved region into a tapered gauge region having a tapered gauge profile, the tapered gauge region being tapered with respect to the longitudinal axis to at least a tilt angle determined by the steerable drilling system;

wherein the cutting profile and the gauge profile lie wholly within a bit profile envelope comprising a three dimensional surface of two complimentary conical sections set at the tilt angle and separated by and blended with a rounded section which forms an outermost diameter of the bit profile envelope; the rounded section having a diameter substantially equal to a maximum allowable API diameter for the drill bit, and further having a radius of curvature substantially equal to one-half the diameter.

2. A drill bit according to claim 1, wherein the tapered gauge region is of generally frusto-conical form.

3. A drill bit according to claim 2, wherein the tapered gauge region has an angle of taper with respect to the longitudinal axis which is greater than the tilt angle through which the bit experiences, in use.

4. A drill bit according to claim 3, wherein the tapered gauge region has an angle of taper with respect to the longitudinal axis of 8° or less.

5. A drill bit according to claim 4, wherein the tapered gauge region has an angle of taper with respect to the longitudinal axis of 4° or less.

6. A drill bit according to claim 1, wherein the gauge region is of concave shape.

7. A drill bit according to claim 1, wherein the gauge region is of smoothly curved convex shape.

8. A drill bit according to claim 6, wherein the gauge region is relieved from the bit profile envelope.

9. A drill bit according to claim 1, wherein the gauge region is convexly curved.

10. A drill bit according to claim 1, wherein the gauge region is free of cutting elements.

11. A drill bit according to claim 1, wherein at least one cutting element is provided on the gauge region so as to form an active gauge.

12. A drill bit according to claim 1, wherein at least one low protrusion reaming cutting element is provided on the gauge region.

13. A drill bit according to claim 1, wherein the leading face section of the bit is of generally part spherical shape.

14. A steerable drilling system comprising a point-the-bit type steering arrangement having a tilt angle and carrying a drill bit comprising a longitudinal axis, and a cutting profile comprising a leading face section blended with a curved region into a tapered gauge region having a tapered gauge profile, the tapered gauge region being tapered with respect to the longitudinal axis determined by the steerable drilling system;

wherein the cutting profile and the gauge profile lie wholly within a bit profile envelope comprising a three dimensional surface of two complimentary conical sections set at the tilt angle and separated by and blended with a rounded section which forms an outermost diameter of the bit profile envelope; the rounded section having a diameter substantially equal to a maximum allowable API diameter for the drill bit, and further having a radius of curvature substantially equal to one-half the diameter.

15. A drilling system according to claim 14, wherein the steering arrangement includes a housing from which an angled drive shaft protrudes, the bit being mounted, in use, upon the drive shaft, and a downhole motor arranged to drive the housing for rotation about its axis.

* * * * *